US005224823A

United States Patent [19]

Cordts

[11] Patent Number: 5,224,823

[45] Date of Patent: Jul. 6, 1993

[54] COOLING WATER PUMP FOR USE ON THE PUMP HOUSING OF AN INTERNAL COMBUSTION ENGINE

[75] Inventor: Detlef Cordts, Mörlenbach, Fed. Rep. of Germany

[73] Assignee: Firma Carl Freudenberg, Weinheim an der Bergstrasse, Fed. Rep. of Germany

[21] Appl. No.: 807,272

[22] Filed: Dec. 13, 1991

[30] Foreign Application Priority Data

Dec. 15, 1990 [DE] Fed. Rep. of Germany ..... 4040200

[51] Int. Cl.[5] ..... F01D 1/02

[52] U.S. Cl. ..... 415/206; 415/203; 417/362; 416/186 R; 416/185

[58] Field of Search ..... 415/206, 203, 170.1; 416/182, 185, 186 R, 188; 417/362

[56] References Cited

U.S. PATENT DOCUMENTS

| | | | |
|---|---|---|---|
| 2,710,580 | 6/1955 | Holzwarth | 416/186 |
| 3,205,828 | 9/1965 | Rupp | 415/206 |
| 4,111,598 | 9/1978 | Kasuya | 415/203 |
| 4,793,771 | 12/1988 | Laing | 415/206 |
| 4,802,820 | 2/1989 | Komatsu | 415/203 |
| 4,911,610 | 3/1990 | Olschewski | 415/170.1 |
| 5,026,253 | 6/1991 | Börger | 415/170.1 |

*Primary Examiner*—Edward K. Look
*Assistant Examiner*—Mark Sgantzos
*Attorney, Agent, or Firm*—Kenyon & Kenyon

[57] ABSTRACT

A cooling water pump for a pump housing of an internal combustion engine includes a bearing cover that can be fixed within a bore of the pump housing. The pump also includes a pump shaft and a bearing. The pump shaft is rotatably mounted in the bearing. An impeller and a pulley are each coupled to the pump shaft, and the impeller has an inlet opening that is circular in shape and concentric with the impeller. The inlet opening is disposed at the end of the impeller that faces the pump housing in the axial direction. A first concentrically formed covering covers the impeller and is impermeable to liquids flowing in the axial direction. The first covering is disposed in first zones located radially beyond the inlet opening, and the impeller is open in second zones located on a side of the impeller axially opposite the first covering.

20 Claims, 2 Drawing Sheets

COOLING WATER PUMP FOR USE ON THE PUMP HOUSING OF AN INTERNAL COMBUSTION ENGINE

BACKGROUND OF THE INVENTION

The present invention relates generally to a cooling water pump and more particularly to a cooling water pump for use on the pump housing of an internal combustion engine.

Such a cooling water pump is disclosed in DE-PS 22 55 017. This reference discloses a pump in which the impeller is open axially in the direction of the pump housing. The bearing cover, which is structured like a flange, is sealed with respect to the pump housing by a flexible flange gasket. The output capacity that can actually be achieved is to high degree dependent on the precision of the gap between the impeller and the pump housing, which is a function of the production technology. The output capacity is also dependent on the coverage of the impeller by the pump housing, in the case of adjustable pumps, and can therefore vary to a significant degree.

Thus, one limitation of the prior art is that there is no cooling water pump that can be manufactured in such a manner as to result in a precise output capacity that can be predetermined.

SUMMARY OF THE INVENTION

The present invention provides a cooling water pump for a pump housing of an internal combustion engine. The pump includes a bearing cover that can be fixed within a bore of the pump housing. The pump also includes a pump shaft and a bearing. The pump shaft is rotatably mounted in the bearing. An impeller and a pulley are each coupled to the pump shaft, and the impeller has an inlet opening that is circular in shape and concentric with the impeller. The inlet opening is disposed at the end of the impeller that faces the pump housing in the axial direction. A first concentrically formed covering covers the impeller and is impermeable to liquids flowing in the axial direction. The first covering is disposed in first zones located radially beyond the inlet opening, and the impeller is open in second zones located on a side of the impeller axially opposite the first covering. Hence, in all sectors, the inlet opening is surrounded by fixed components of the impeller. Accordingly, the inlet cross-section has precise values. Independent of any particular events that occur during the assembly of each individual pump, this configuration assures a precise, definable output capacity. Therefore, the possibility of optimally adapting the individual elements of the cooling system to one another is greatly improved.

According to another aspect of the invention, the cooling water pump may also include a second concentrically formed covering that covers the impeller that is impermeable to liquids flowing in the axial direction. The second covering is disposed radially within the second zones of the axial end of the impeller that is opposite the pump housing. This configuration yields a structure that has great rigidity, while only using a small amount of materials. The impeller can be produced in a particularly cost effective manner by injection molding or by pressing, using a die which has only two mold halves.

The first and second coverings may each be bounded by a surface that faces the other and which curve in the same direction. Furthermore, the curve of each bounded surface of the first and second coverings may have a profile adapted to the direction of flow of cooling water that traverses various sectors when the pump is in use. In addition to providing a cooling water pump that can be used for an extended period of time, this embodiment of the invention also optimizes the effectiveness of the pump.

According to yet another aspect of the invention, the second covering may have an outer diameter that is no larger than an inner diameter of the first covering. Because of this structure, the blades of the impeller are connected to a covering at any desired distance from the axis of rotation, which significantly improves the mechanical strength. It has proven particularly advantageous if the impeller and the covers are formed in one piece, with a transitional region from one to the other. The impeller may be advantageously formed from metal or plastic, and advantageous production methods include injection molding or pressing.

A particularly precise relative relation between the cooling water pump and the pump housing can be achieved if the pump cover is sealed to the pump housing by an O-ring gasket. In this regard, it is advantageous if the gasket is arranged in a groove of the pump cover, which has a size such that when contact occurs between the pump cover and the pump housing, only a slight elastic deformation of the O-ring results.

It has proven to be particularly advantageous if the pump cover has a groove containing the O-ring gasket such that the groove is disposed in a cylindrical surface of the pump cover and is open in the radial direction. The O-ring can be made to engage with the bore of the pump housing. On the one hand, this configuration permanently fixes the O-ring gasket of the cooling water pump, which is very advantageous for storage and transportation. On the other hand, this configuration yields an elastic deformation of the O-ring gasket that can be precisely predetermined before it is assembled. Thus, a good seal can be achieved without performing complicated inspections.

The impeller may terminate in the axial direction at surfaces which surround in all sectors a central point within the bearing from an equal distance extending to an area of the second zones. The surfaces form nothing other than components of an imaginary spherical surface that surrounds the central point of the bearing from a constant distance R. Any angular shifting of the shaft carrying the impeller, which may occur as a consequent of drift in the bearing due to wear, or due to the construction of the bearing, no longer result in direct contact between the impeller and the bearing cover, but rather result only in a parallel shift of the surfaces which are opposite each other. Thus, the output capacity of the cooling water pump is not impaired in any way.

Furthermore, the surfaces in all the sectors are spaced a uniform distance from an opposite surface of the bearing cover. The profile of the opposite surface may supplement the profile of the second covering in this case, avoiding a sudden change of direction, which is of great advantage for achieving good output capacity.

DETAILED DESCRIPTION

Figure 1:
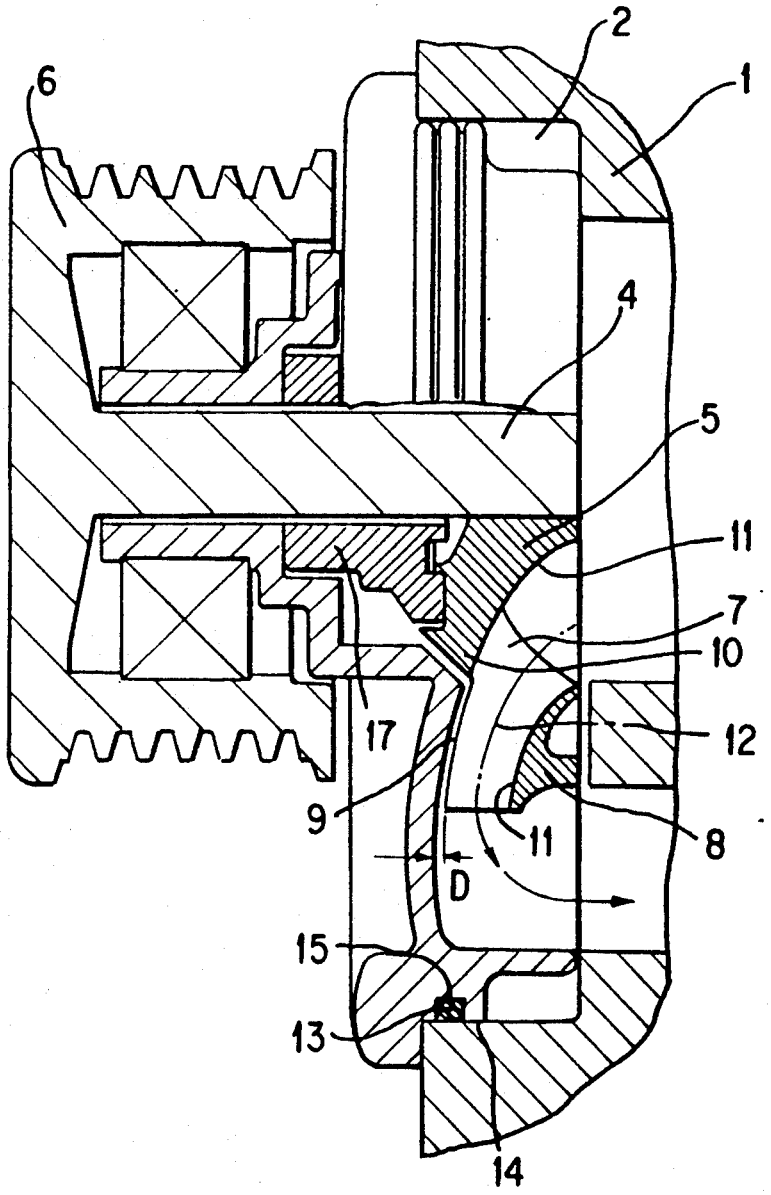
FIG. 1 shows a partial, cross-sectional view of a cooling water pump constructed according to the principles of the invention.

The cooling water pump shown in FIG. 1 is intended for use on the pump housing 1 of an internal combustion engine. The pump comprises a bearing cover 3 which can be fixed in place within a bore 2 of the pump housing, in which a pump shaft 4 is mounted. The pump shaft 4 is made of a metallic material, and is formed in one piece with a pulley 6. The pump shaft 4 may also be formed of plastic. The pump shaft 4 has an impeller wheel 5 fixed thereto so that the impeller 5 does not rotate therewith. The impeller 5 is disposed on the end of the shaft 4 projecting axially toward the pump housing 1, and is mounted such that it can rotate relative to a projecting extension of the bearing cover 3, by means of a roller bearing, via the pulley 6. The extension of the bearing cover 3 also comprises a slide ring seal 17, which contacts the side of the impeller 5 opposite the pump housing 1 in the axial direction, so that the slide ring seal 17 and the impeller 5 rotate relative to one another and form a seal.

The bearing cover 3 is provided with a rotating cylindrical surface 14 that extends in the axial direction. The surface 14 is interrupted in the axial direction by a rotating groove 15 which is open in the radial direction. An O-ring gasket 13 is arranged in the groove 15. The gasket 13 is formed from a rubber elastic material, and it contacts the bore 2 to form a seal therebetween, after being inserted in the bearing cover 3.

The impeller 5 has an inlet opening 7 that is circular in shape and concentric therewith. The inlet opening 7 is disposed at the axial end of the impeller 5 facing the pump housing 1, where the impeller 5 is covered by a concentrically formed first cover 8 that is impermeable to liquids flowing in the axial direction. The first covering 8 is located in the zones radially outside the inlet opening 7. Further, the impeller 5 is open in the zones 9, which are on the end of the impeller 5 axially opposite the first covering 8. The impeller 5 is covered by a concentrically formed second covering, which is impermeable to liquids flowing in the axial direction. The second covering is located radially within the open zones 9 of the axial end facing away from the pump housing, where the first and second coverings are bounded by surfaces 11 which curve in the same direction on the sides that face each other. The surfaces 11 may, however, also be related to one another in some other way. In the present embodiment, they have a profile which is adapted to the direction of flow 12 of the cooling water which passes through the various sectors while the pump is in use. Furthermore, the second covering 10 has an outer diameter that is at most just as large as the inner diameter of the first covering 8. In this way, the impeller 5 can be easily produced in one piece, from metal or plastic, using pressing, injection, or injection molding methods, and using a mold which has only two mold halves. In addition to a very high molding accuracy, the impeller 5 has particularly high-strength properties as well as smooth surfaces. Thus, cavitation that occurs while the pump is in use is effectively countered.

The axes of the cylindrical surface 14 and the pump shaft 4, as well as the components rotating therewith, are disposed on bearings that have parallel axes. Consequently, it is possible to change the distance between the axes of the pulley 6 and another pulley (not shown) which is operatively coupled to the pulley 6 by means of a belt so that when the pump is in use, there is a relative rotation of the bearing cover 3 in the bore 2 of the pump housing 1. This configuration simplifies the adjustment of the tension in the belt, which is sufficient to transfer the forces required for driving the coolant pump. Because of the special shape of the impeller 5, the result achieved is that even if the bearing cover 3 is rotated, the output capacity of the coolant pump does not change.

Figure 2:
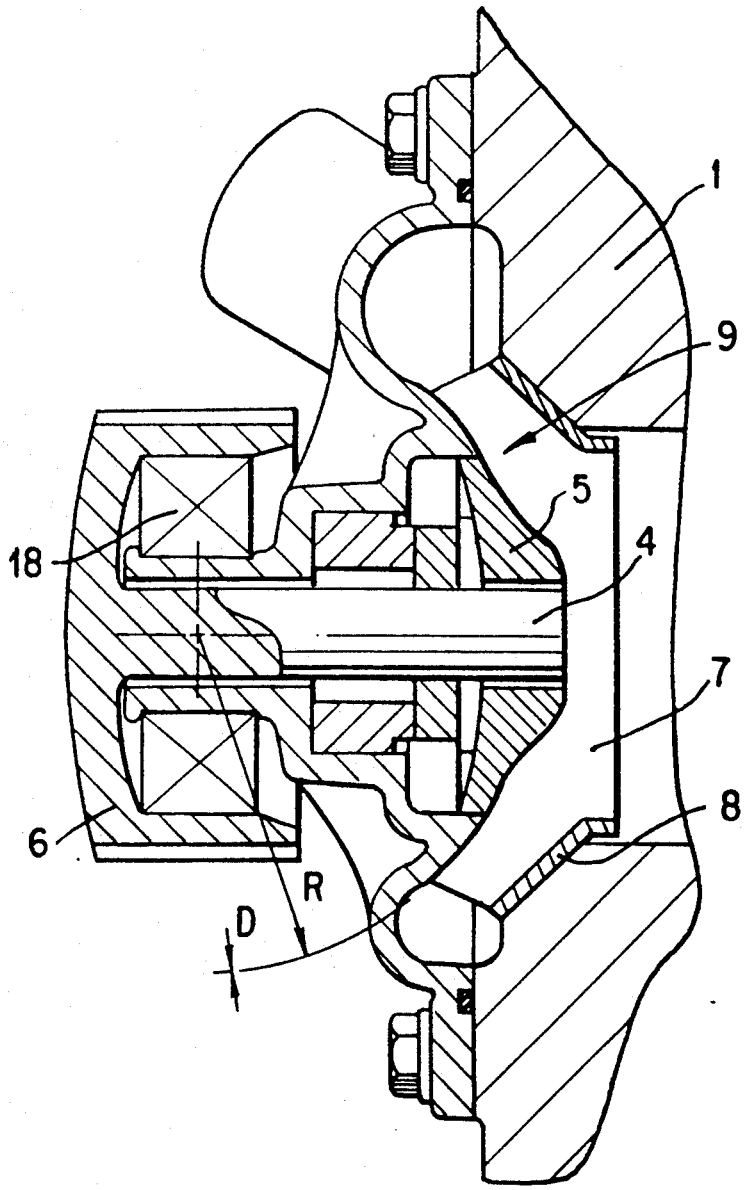
FIG. 2 shows a partial, cross-sectional view of an alternative embodiment of the cooling water pump of the present invention.

FIG. 2 shows a cooling water pump in which the impeller 5 terminates in the axial direction at surfaces which surround in all sectors the central point within the bearing from an equal distance R, in the area of the open zones. The surfaces in all the sectors are spaced a uniform distance D from the opposite surface of the bearing cover 3, which is designed to have rotational symmetry. As a result of this configuration, any angular shift in positions between the pump shaft 4 and the impeller 5 caused by wear of the bearing 18 will not result in direct contact between the opposite surfaces in the area of the zones 9. The surfaces will merely undergo a parallel displacement relative to one another. Hence, a change in the output capacity in the pump is clearly avoided.

What is claimed is:

1. A cooling water pump for use on a pump housing of an internal combustion engine, the pump housing having surfaces defining a bore, said pump comprising:
   - a bearing cover that can be fixed within the bore of the pump housing;
   - a pump shaft and a bearing, said pump shaft being rotatably mounted in said bearing;
   - an impeller and a pulley each coupled to said pump shaft, said impeller having an inlet opening that is circular in shape and concentric with said impeller, said inlet opening being disposed at the end of the impeller that faces the pump housing in the axial direction;
   - a first concentrically formed covering covering said impeller, said first covering being impermeable to liquids flowing in the axial direction, said first covering being disposed in first zones located radially beyond the inlet opening, said impeller being open in second zones located on a side of said impeller axially opposite the first covering.

2. The cooling water pump of claim 1, further comprising a second concentrically formed covering covering said impeller which is impermeable to liquids flowing in the axial direction, said second covering being disposed radially within the second zones of the axial end of the impeller that is opposite the pump housing.

3. The cooling water pump of claim 1, wherein the first and second coverings are each bounded by a surface that face the other and which curve in the same direction.

4. The cooling water pump of claim 3, wherein the curve of each bounded surface of the first and second coverings has a profile adapted to the direction of flow of cooling water traversing various sectors when said pump is in use.

5. The cooling water pump of claim 1, wherein said first covering has an inner diameter and said second covering has an outer diameter that is no larger than the inner diameter of the first covering.

6. The cooling water pump of claim 3, wherein said first covering has an inner diameter and said second covering has an outer diameter that is no larger than the inner diameter of the first covering.

7. The cooling water pump of claim 4, wherein said first covering has an inner diameter and said second covering has an outer diameter that is no larger than the inner diameter of the first covering.

8. The cooling water pump of claim 1, wherein said impeller and said first and second coverings are formed as a single integral unit.

9. The cooling water pump of claim 5, wherein said impeller and said first and second coverings are formed as a single integral unit.

10. The cooling water pump of claim 1, further comprising an O-ring gasket forming a seal between said pump cover and said bore.

11. The cooling water pump of claim 3, further comprising an O-ring gasket forming a seal between said pump cover and said bore.

12. The cooling water pump of claim 5, further comprising an O-ring gasket forming a seal between said pump cover and said bore.

13. The cooling water pump of claim 9, further comprising an O-ring gasket forming a seal between said pump cover and said bore.

14. The cooling water pump of claim 10, wherein said pump cover has a groove containing said O-ring gasket, said groove being disposed in a cylindrical surface of said pump cover and being open in the radial direction.

15. The cooling water pump of claim 1, wherein said impeller terminates in the axial direction at surfaces which surround in all sectors a central point within said bearing from an equal distance extending to an area of the second zones.

16. The cooling water pump of claim 2, wherein said impeller terminates in the axial direction at surfaces which surround in all sectors a central point within said bearing from an equal distance extending to an area of the second zones.

17. The cooling water pump of claim 4, wherein said impeller terminates in the axial direction at surfaces which surround in all sectors a central point within said bearing from an equal distance extending to an area of the second zones.

18. The cooling water pump of claim 6, wherein said impeller terminates in the axial direction at surfaces which surround in all sectors a central point within said bearing from an equal distance extending to an area of the second zones.

19. The cooling water pump of claim 12, wherein said impeller terminates in the axial direction at surfaces which surround in all sectors a central point within said bearing from an equal distance extending to an area of the second zones.

20. The cooling water pump of claim 15, wherein said surfaces in all sectors are spaced a uniform distance from an opposite surface of the bearing cover.

* * * * *